US006145604A

United States Patent [19]

Bartette

[11] Patent Number: 6,145,604

[45] Date of Patent: Nov. 14, 2000

[54] CORE MACHINE

[75] Inventor: Pascal Bartette, Miami, Fla.

[73] Assignee: Dresser Industries, Inc., Dallas, Tex.

[21] Appl. No.: 09/194,902

[22] PCT Filed: Jun. 3, 1997

[86] PCT No.: PCT/EP97/02964

§ 371 Date: Dec. 4, 1998

§ 102(e) Date: Dec. 4, 1998

[87] PCT Pub. No.: WO97/46790

PCT Pub. Date: Dec. 11, 1997

[30] Foreign Application Priority Data

Jun. 5, 1996 [BE] Belgium ..... 09600504

[51] Int. Cl.[7] ..... E21B 25/10; E21B 25/00

[52] U.S. Cl. ..... 175/250; 175/249

[58] Field of Search ..... 175/249, 250, 175/403, 405.1, 332

[56] References Cited

U.S. PATENT DOCUMENTS

| | | | |
|---|---|---|---|
| 1,870,592 | 8/1932 | Schuerman | 175/332 |
| 4,512,423 | 4/1985 | Aumann et al. | 175/249 |
| 4,643,265 | 2/1987 | Aiura et al. | 175/249 |

FOREIGN PATENT DOCUMENTS

| | | |
|---|---|---|
| 0134586 | 3/1985 | European Pat. Off. . |
| 0356657 | 3/1990 | European Pat. Off. . |
| 1160409 | 8/1969 | United Kingdom . |
| 2000824 | 1/1979 | United Kingdom . |

*Primary Examiner*—Robert E. Pezzuto
*Assistant Examiner*—Meredith C. Petravick
*Attorney, Agent, or Firm*—Browning Bushman

[57] ABSTRACT

Core machine intended particularly to the oil prospection field, comprising a core crown (2), an external tube (3) for the rotational driving of the core crown (2), and an internal tube (4) having a free front end element (7) intended to receive a core (5), and a revolution surface (8) of the free end element (7) on the crown side (2), arranged to cooperate with an internal surface (9) thereof, or optionally of the external tube (3), so as to adjust between the two a predetermined passage for the core drilling fluid, the free end element (7) being mounted in the core drilling machine (1) so as to slide coaxially on an extremity section (13) of the internal tube (4), between a position wherein the revolution surface (8) is in contact with the internal surface (9) of the crown (2), or respectively of the external tube (3), and an extreme position away from said internal surface (9).

16 Claims, 2 Drawing Sheets

CORE MACHINE

BACKGROUND OF THE INVENTION

The present invention relates to a core sampler, particularly in the field of oil prospecting, comprising:

a core-sampling ring, an outer barrel for rotating the sampling ring, and an inner barrel which has a free front end element and is intended to accommodate a core sample during sampling, the inner and outer barrels being more or less coaxial, and a surface of revolution of the free end element, on the same side of the ring, designed to interact with an internal surface of the latter, or, if appropriate, of the outer barrel, so as together to set a predetermined passage for core-sampling fluid.

In the case of a core-sampler of this kind, the free end element of the inner barrel has a circular lip parallel to the longitudinal axis of rotation and situated in an annular housing in the ring, which also extends parallel to the longitudinal axis of rotation. Regulating the passage for fluid herein proves tricky, for example given that the inner barrel is fixed to the outer barrel a great distance away from the position of this passage and given the significant variations in length which may occur in a core sampler on account of the variable and high temperatures that the latter may experience during sampling. To date, the operator assembling a core sampler tries to obtain a correct setting of this passage by taking account of the differences in length exhibited by the various portions of the inner and outer barrels, and by taking account of the temperatures which it is assumed are reached during core sampling. It is, however, known that in practice the passage actually obtained may be too different from the one anticipated. Furthermore, the inner barrel may be made of a different material (for example glass fibre coated with a binder) from that of the outer barrel, which is usually made of steel, and the differential expansions that these two barrels undergo oppose the obtaining and/or maintaining of the desired setting for the fluid passage. Furthermore, a core sample entering the inner barrel may push the latter slightly towards the top of the outer barrel, depending on the play in the thrust ball bearings or ball bearings which connect the inner and outer barrels, and this may change the aforementioned setting appreciably.

In either event, poor setting of the said passage may lead, for example, to an excessive flow rate of sampling fluid towards the core sample and to a possibly deep adverse alteration thereof by washing, etc., or may, for example, lead to excessive contact between the said surface of revolution of the free end element and the internal surface of the ring or of the outer barrel, leading to seizure of these surfaces as one rotates with respect to the other, or to deformation and/or breakage of the free end element, etc.

The object of the present invention is to overcome the aforementioned drawbacks, and others which are not explained hereinabove but are known to those skilled in the art, and to provide a means that makes it possible simply and reliably to obtain the correct regulation, even regulation down to zero or almost zero passage for the core-sampling fluid between the free end element of the inner barrel and the corresponding internal bearing surface, without troublesome pressure of one on the other, and therefore without the aforementioned risks of seizure, deformation or breakage at this point.

To this end, according to the present invention, the free end element is mounted in the core sampler in such a way that it can slide coaxially over an end portion of the inner barrel, between a position in which the surface of revolution is in contact with the internal surface of the ring or of the outer barrel, respectively, and an extreme position away from this internal surface.

In one embodiment of the invention, the sliding free end element and the end portion each comprise a stop, which stops interact with one another when the inner barrel is withdrawn from its core-sampling position in the outer barrel, so as to lock the free end element on the end portion in another extreme position situated beyond the said contact position starting from the extreme position away from the internal surface.

Other details and particular features of the invention will emerge from the secondary claims and from the description of the drawings which are appended to this text and which illustrate, by way of non-limiting examples, some embodiments of the invention.

DETAILED DESCRIPTION

In the various figures, the same reference notation is used to denote elements which are identical or analogous. To improve the clarity of the drawings, some elements of the core sampler have been depicted by their outline in chain line and without hatching.

Figure 1:
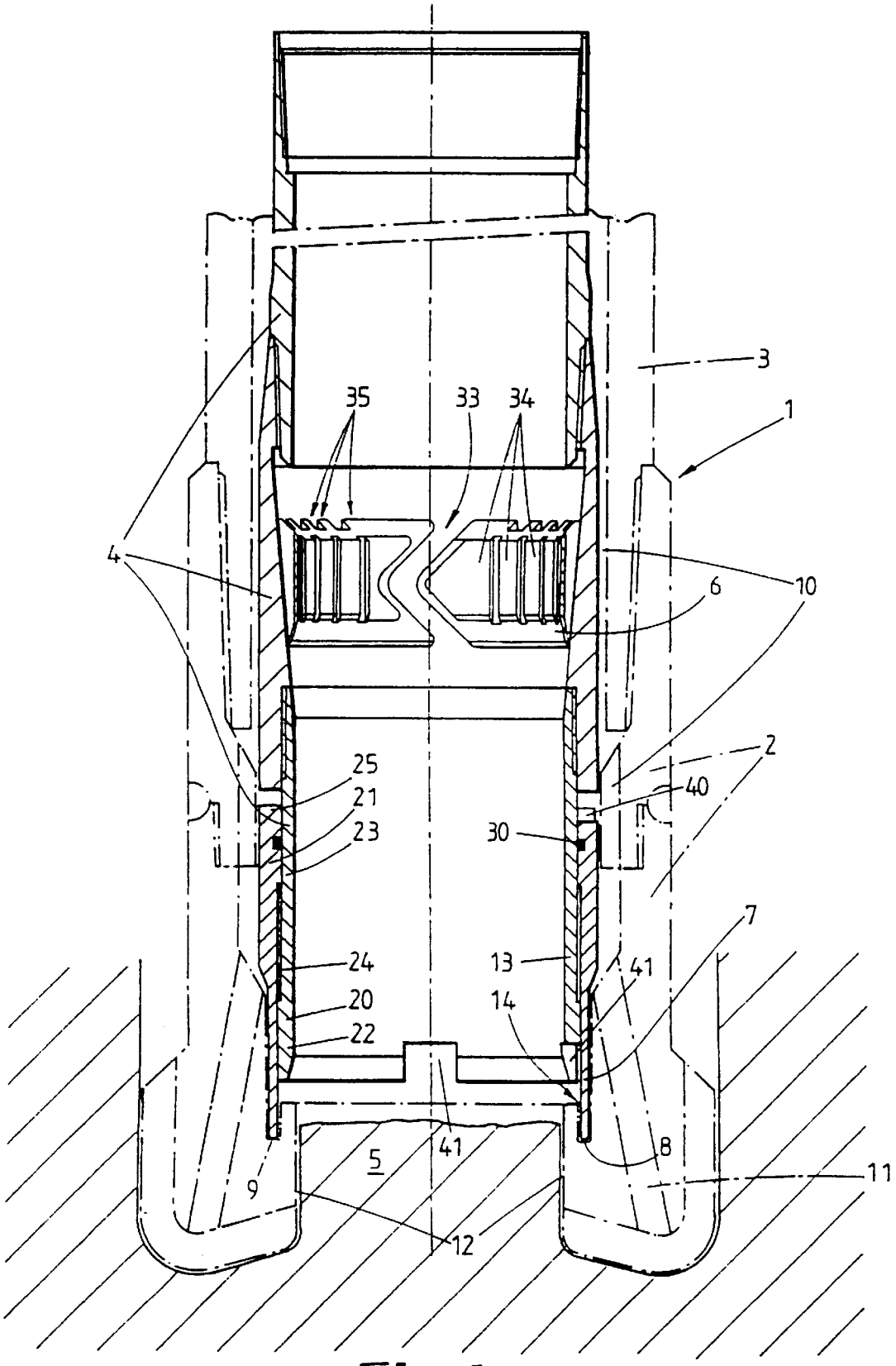
FIG. 1 depicts diagrammatically in axial section, a length of a core sampler equipped in accordance with the invention.

The core sampler 1 in FIG. 1 has a sampling ring 2 mounted on an outer barrel 3, intended, among other things, for rotating the ring 2, and an inner barrel 4, intended to receive a core sample 5 during a core-sampling operation. A split frustoconical ring 6 is provided in the inner barrel 4 and is intended to lock a core sample therein. The inner 4 and outer 3 barrels are each formed of various lengths of barrel fixed together, for example by screwing, and are practically coaxial. The inner barrel 4 has a free front end 7, when considering the direction of forward travel of the core sampler 1 during a core-sampling operation. This free end element 7 is delimited by a surface of revolution 8 designed to interact with an internal surface 9 of the ring 2 or, as appropriate, of the outer barrel 3 in a mutual arrangement of these two components mounted one on or in the other, so as to regulate, between the surface of revolution 8 and the internal surface 9, a predetermined passage for core-sampling fluid.

In the case of FIG. 1, the core-sampling fluid is conveyed through an annular duct 10 delimited by the inner 4 and outer 3 barrels, so as to end up at the bottom of a core-sampling hole via nozzles 11 in the ring 2. It may be desirable for a small amount of core-sampling fluid to be able, however, to pass directly from the annular duct 10 as far as a gap 12 between a core sample 5 and the ring 2, so as to lubricate and cool this point of friction between these two components. These flow of fluid to this gap must, however, be limited so as to prevent this fluid from adversely affecting the core sample produced.

To achieve this, and for the reasons explained earlier, the free end element 7 is mounted in the core sampler 1 in such a way that it can slide coaxially over an end portion 13 of the inner barrel 4, between a position in which the surface of revolution 8 is in contact with the said internal surface 9 and an extreme position away from this internal surface 9.

In the embodiment of FIG. 1, the free end element 7 ends in a groove 14 which extends parallel to the longitudinal axis of the core sampler 1 and which, in its bottom, comprises the internal surface 9 for the bearing of the surface of revolution 8.

Figure 2:
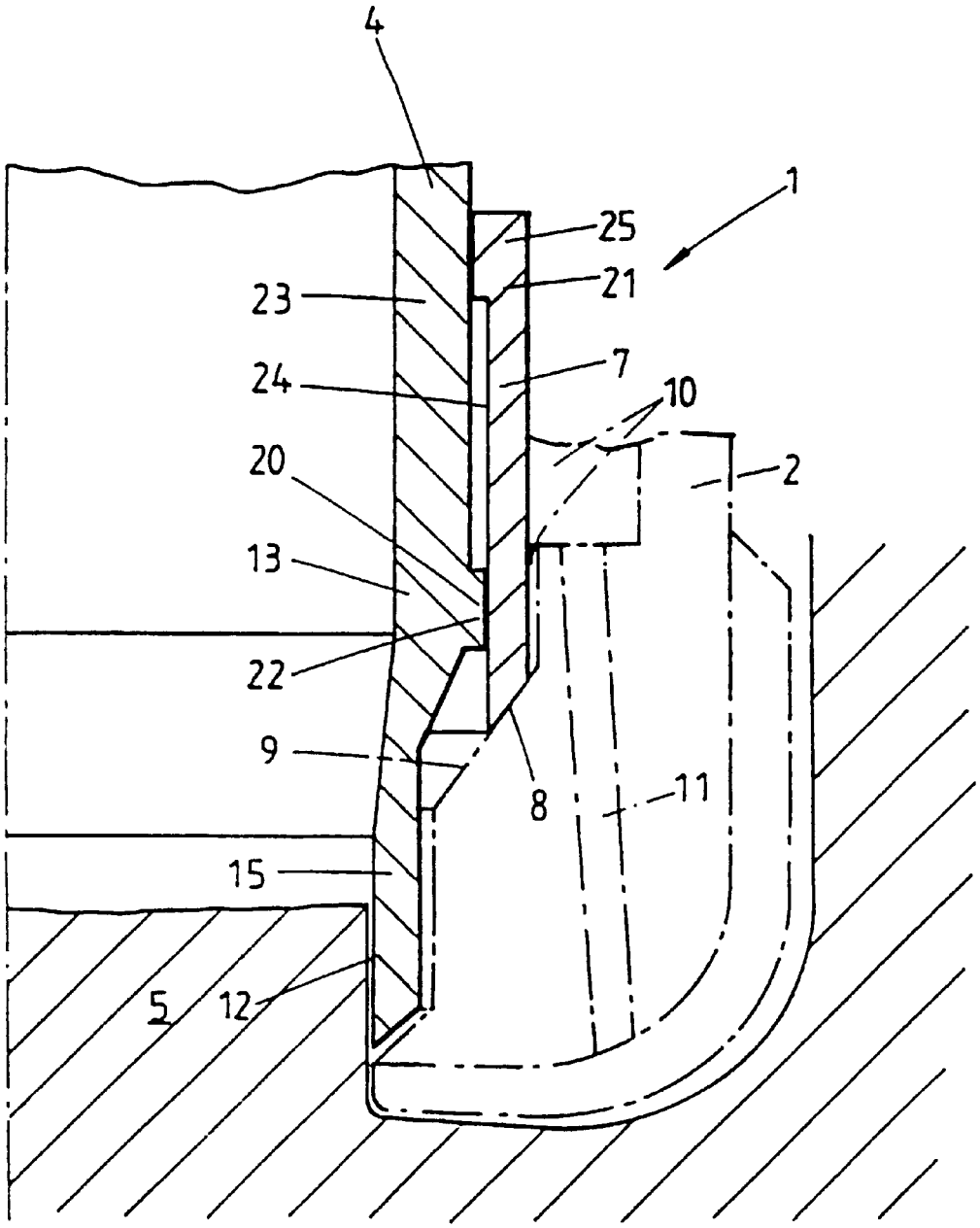
FIG. 2 diagrammatically depicts, on a different scale, in axial half-section, a length of another core sampler equipped in accordance with the invention.

In the embodiment of FIG. 2, the free end element 7 ends against an internal surface 9 of the ring 2 and the end portion 13 has another free end element 15 fixed to it and which, in the core-sampling position in the core sampler 1 can project from the sliding free end element 7.

The sliding set-up can be adjusted so that the pressure of the core-sampling fluid, acting on the surfaces of the free end element 7, presses the surface of revolution 8 and the internal surface 9 against each other. The pressing force can be considered as being low given the small amount of surface area that the free end element 7 presents or can present to the fluid pressure. This pressing force may, however, be increased by known hydraulic means (pressure drops, for example, and/or increase in flow rate) to prevent the free end element 7 from being pushed upwards, for example by core-sample debris passing between the ring 2 and the end length 13.

According to the drawings of FIGS. 1 and 2, the contact between the surface of revolution 8 and the internal surface 9 may be continuous and the passage for fluid through the annular duct 10 towards the gap 12 is then practically closed. It is, however, possible, for example, to equip the free end element 7 with calibrated passage holes (not depicted) or calibrated cuts (not depicted) made in the surface of revolution 8 in order to allow a predetermined flow rate of fluid (depending on the fluid pressure) to pass.

The sliding free end element 7 may furthermore be mounted so that it can turn on the end length 13. This, for example, allows the wear due to friction as the outer barrel 3 rotates with respect to the inner barrel 4 to be spread between the point of contact between the surface of revolution 8 and the internal surface 9, and the point of contact between the free end element 7 and the end length 13, or alternatively, allows this wear to be transferred to the latter point, the components of which are, for example, removable and replaceable.

For this reason, at least the said end length 13 may be fitted on the rest of the inner barrel 4 removably.

The free end elements 7 and end length 13 may be made of different materials from the inner barrel 4, outer barrel 3, and ring 2 and be selected on the basis of the friction they are to experience.

As a preference, the free end element 7 and the end length 13 each comprise a stop 20, 21 interacting with one another, when the inner barrel 4 is withdrawn from its core-sampling position into the outer barrel 3. The stops 20, 21 interact in such a way as to lock the free end element 7 on the said end length 13 in another extreme position (not depicted) situated away from the said position of contact between the surface of revolution 8 and the internal surface 9 with respect to the first mentioned extreme position away from the internal surface 9.

Advantageously, the end portion 13 may comprise, by way of a stop 20, on the side that is towards the bottom of the well in the sampling position, an external cylindrical collar 22 and, between this and the rest of the inner barrel 4, a cylindrical body 23 of smaller outside diameter than the external cylindrical collar 22. The free end element 7 then comprises, on the same side as this same well bottom, an open-ended cylindrical hole 24, the inside diameter of which is adapted to the outside diameter of the external collar 22 for the purpose of the aforementioned sliding and, on the opposite side to the well bottom, by way of a stop 21, an internal cylindrical collar 25, the inside diameter of which is smaller than that of the cylindrical hole 24 and which is adapted to the outside diameter of the cylindrical body 23 with a view to the said sliding.

It must be understood that the invention is not in any way restricted to the embodiments described and that many modifications can be made to the latter without departing from the scope of the present invention.

Thus, in the core sampler according to the invention, the arrangement whereby the end portion 13 is mounted on the rest of the inner barrel 4 so that it can be removed, may consist, for example, of an assembly with an external screw thread on the end portion 13, on its end away from the well bottom, and an internal screw thread on the corresponding end of the rest of the inner barrel 4. As a preference, the external screw thread has a diameter at most equal to the outside diameter of the cylindrical body 23 and, when the screw threads are cylindrical, they are advantageously left-hand threads.

A seal 30 may be mounted, for example, in the internal surface of the internal cylindrical collar 25 so as to interact with the external peripheral surface of the cylindrical body 23 and thus improve sampling-fluidtightness at this point.

The core sampler 1 of the invention advantageously comprises a split frustoconical ring 6 as depicted in FIG. 1 and having a V-shaped cut 33 where it is split, an internal cylindrical surface 34 which has been roughened, in the known way, in order to catch on a core sample 1, and a grooved external frustoconical surface 35.

One or more notches 40 may be provided on a face of the free end element 7 which faces towards the rest of the inner barrel 3. These notches 40 may be used for detaching, possibly through fluid pressure, one element 7 with respect to the said remainder of the inner barrel 3.

Notches 41 may be provided on the end face of the unscrewable end length 13, so as to take a tool for screwing or unscrewing this length 13.

What is claimed is:

1. Core sampler, particularly in the field of oil prospecting, comprising:

a core-sampling ring (2), an outer barrel (3) for rotating the sampling ring (2), and an inner barrel (4) which has a free front end element (7) and is intended to accommodate a core sample (5) during sampling, the inner (4) and outer (3) barrels being more or less coaxial, and a surface (8) of revolution of the free end element (7), on the same side of the ring (2), designed to interact with an internal surface (9) of the latter, or, if appropriate, of the outer barrel (3), so as together to set a predetermined passage for core-sampling fluid, characterized in that the free end element (7) is mounted in the core sampler (1) in such a way that it can slide coaxially over an end portion (13) of the inner barrel (4), between a position in which the surface (8) of revolution is in contact with the internal surface (9) of the ring (2) or of the outer barrel (3), respectively, and an extreme position away from this internal surface (9).

2. Core sampler according to claim 1, characterized in that the sliding free end element (7) is mounted so that it can turn on the aforementioned end portion (13).

3. Core sampler according to claim 1, characterized in that the sliding free end element (7) and the end portion (13) each comprise a stop (20, 21), which stops interact with one another when the inner barrel (4) is withdrawn from its core-sampling position in the outer barrel (3), so as to lock the free end element (7) on the end portion (13) in another extreme position situated beyond the said contact position with respect to the extreme position away from the internal surface (9).

4. Core sampler according to claim 1, characterized in that the said end portion (13) is designed so that it can be removed from the rest of the inner barrel (4).

5. Core sampler according to claim 4, characterized in that the end portion (13) comprises, by way of a stop (20), on the side that is towards the bottom of the well in the sampling position, an external cylindrical collar (22) and, between this and the rest of the inner barrel (4), a cylindrical body (23) of smaller outside diameter than the external cylindrical collar (22) and in that the free end element (7) comprises, on the same side as this same well bottom, an open-ended cylindrical hole (24), the inside diameter of which is adapted to the outside diameter of the external collar (22) for the purpose of the aforementioned sliding and, on the opposite side to the well bottom, by way of a stop (21), an internal cylindrical collar (25), the inside diameter of which is smaller than that of the cylindrical hole (24) and which is adapted to the outside diameter of the cylindrical body (23) with a view to the said sliding.

6. Core sampler according to claim 4, characterized in that the arrangement whereby the end portion is mounted on the rest of the inner barrel (4) so that it can be removed, consists of an assembly with an external screw thread on the end portion (13), on its end away from the well bottom, and an internal screw thread on the corresponding end of the rest of the inner barrel (4), in that, as a preference, the external screw thread has a diameter at most equal to the outside diameter of the cylindrical body (23) and in that, when the screw threads are cylindrical, they are advantageously left-hand threads.

7. Core sampler according to any one of claim 1, characterized in that it comprises pressure responsive hydraulic pressing means designed to act on the free end element (7) so as to press the surface (8) of revolution onto the internal surface (9) with a controlled force.

8. Core sampler according to claim 2, characterized in that the sliding free end element (7) and the end portion (13) each comprise a stop (20, 21), which stops interact with one another when the inner barrel (4) is withdrawn from its core-sampling position in the outer barrel (3), so as to lock the free end element (7) on the end portion (13) in another extreme position situated beyond the said contact position with respect to the extreme position away from the internal surface (9).

9. Core sampler according to claim 2, characterized in that the said end portion (13) is designed so that it can be removed from the rest of the inner barrel (4).

10. Core sampler according to claim 3, characterized in that the said end portion (13) is designed so that it can be removed from the rest of the inner barrel (4).

11. Core sampler according to claim 5, characterized in that the arrangement whereby the end is mounted on the rest of the inner barrel (4) so that it can be removed, consists of an assembly with an external screw thread on the end portion (13), on its end away from the well bottom, and an internal screw thread on the corresponding end of the rest of the inner barrel (4), in that, as preference, the external screw thread has a diameter at most equal to the outside diameter of the cylindrical body (23) and in that, when the screw threads are cylindrical, they are advantageously left-hand threads.

12. Core sampler according to claim 2, characterized in that it comprises pressure responsive hydraulic pressing means designed to act on the free end element (7) so as to press the surface (8) of revolution onto the internal surface (9) with a controlled force.

13. Core sampler according to claim 3, characterized in that it comprises pressure responsive hydraulic pressing means designed to act on the free end element (7) so as to press the surface (8) of revolution onto the internal surface (9) with a controlled force.

14. Core sampler according to claim 4, characterized in that it comprises pressure responsive hydraulic pressing means designed to act on the free end element (7) so as to press the surface (8) of revolution onto the internal surface (9) with a controlled force.

15. Core sampler according to claim 5, characterized in that it comprises pressure responsive hydraulic pressing means designed to act on the free end element (7) so as to press the surface (8) of revolution onto the internal surface (9) with a controlled force.

16. Core sampler according to claim 6, characterized in that it comprises pressure responsive hydraulic pressing means designed to act on the free end element (7) so as to press the surface (8) of revolution onto the internal surface (9) with a controlled force.

* * * * *

UNITED STATES PATENT AND TRADEMARK OFFICE

CERTIFICATE OF CORRECTION

PATENT NO. : 6,145,604

DATED : November 14, 2000

INVENTOR(S) : Pascal Bartette

It is certified that error appears in the above-identified patent and that said Letters Patent are hereby corrected as shown below:

In the Claims: Claim 7, line 1, delete "any one of".

Signed and Sealed this

Eighth Day of May, 2001

*Attest:*

Nicholas P. Godici

NICHOLAS P. GODICI

*Attesting Officer*

*Acting Director of the United States Patent and Trademark Office*